US009138612B2

(12) United States Patent
Breaux

(10) Patent No.: US 9,138,612 B2
(45) Date of Patent: Sep. 22, 2015

(54) EXERCISE DEVICE

(76) Inventor: Russell Breaux, Flower Mound, TX (US)

( * ) Notice: Subject to any disclaimer, the term of this patent is extended or adjusted under 35 U.S.C. 154(b) by 0 days.

(21) Appl. No.: 12/764,767

(22) Filed: Apr. 21, 2010

(65) Prior Publication Data

US 2011/0263395 A1 Oct. 27, 2011

(51) Int. Cl.

| | |
|---|---|
| ***A63B 21/062*** | (2006.01) |
| ***A63B 21/078*** | (2006.01) |
| ***A63B 21/00*** | (2006.01) |
| ***A63B 23/035*** | (2006.01) |
| ***A63B 23/12*** | (2006.01) |
| *A63B 23/04* | (2006.01) |

(52) U.S. Cl.

CPC ..... *A63B 21/078* (2013.01); *A63B 21/1461* (2013.01); *A63B 23/03516* (2013.01); *A63B 23/03566* (2013.01); *A63B 23/1209* (2013.01); *A63B 23/0494* (2013.01); *A63B 2021/0786* (2013.01)

(58) Field of Classification Search

USPC ..... 482/99–102, 133–135, 104

See application file for complete search history.

(56) References Cited

U.S. PATENT DOCUMENTS

| | | | | |
|---|---|---|---|---|
| 4,211,403 | A * | 7/1980 | Coffaro et al. | 482/138 |
| 4,252,314 | A * | 2/1981 | Ceppo | 482/104 |
| 4,316,609 | A * | 2/1982 | Silberman | 482/102 |
| 4,875,676 | A * | 10/1989 | Zimmer | 482/104 |
| 4,915,379 | A * | 4/1990 | Sapp | 482/138 |
| 5,549,531 | A * | 8/1996 | Campbell | 482/106 |
| 6,090,020 | A * | 7/2000 | Webber | 482/100 |
| 6,645,130 | B2 * | 11/2003 | Webber | 482/142 |
| 7,169,093 | B2 * | 1/2007 | Simonson et al. | 482/103 |
| 2006/0035772 | A1 * | 2/2006 | Golesh et al. | 482/142 |
| 2006/0100069 | A1 * | 5/2006 | Dibble et al. | 482/98 |
| 2007/0082795 | A1 * | 4/2007 | Murray et al. | 482/104 |
| 2008/0004165 | A1 * | 1/2008 | Brawner | 482/104 |

* cited by examiner

*Primary Examiner* — Oren Ginsberg

(74) *Attorney, Agent, or Firm* — Schultz & Associates, P.C.

(57) ABSTRACT

An exercise device for providing exercise for a user may include a substantially vertical chimney frame member, a substantially horizontal chimney frame member connected to the substantially vertical chimney frame member, and a slack adjuster frame member to provide a plurality of exercise modes. The slack adjuster frame member may include a top slack adjuster frame member, and the slack adjuster frame member may include a bottom slack adjuster frame member. The plurality of operating modes may include at least one operating mode from the group of a bench press to perform bench press exercises, a decline press to perform decline press exercises, a preacher curls to perform preacher curls exercises, a military press to perform military press exercises, and an incline press to perform incline press exercises.

9 Claims, 13 Drawing Sheets

Decline Press

Decline Press

Preacher Curls

Military Press

Incline Press

Bench Press

FIRURE 10

EXERCISE DEVICE

FIELD OF THE INVENTION

This invention relates to the field of exercise equipment, and particularly to an apparatus for operating in multiple modes of press exercises.

BACKGROUND

Many different types of exercise machines have been developed for strengthening a user's muscles. Multi-station, or so called "universal", exercise machines are very popular for home use since many different exercises can be performed on a single apparatus. Machines of this type generally have a single weight slack that may be coupled to the various exercise stations by means of a cable/pulley system.

SUMMARY

An exercise device for providing exercise for a user may include a substantially vertical chimney frame member, a substantially horizontal chimney frame member connected to the substantially vertical chimney frame member, and a slack adjuster frame member to provide a plurality of exercise modes.

The slack adjuster frame member may include a top slack adjuster frame member, and the slack adjuster frame member may include a bottom slack adjuster frame member.

The plurality of operating modes may include at least one operating mode from the group of a bench press to perform bench press exercises, a decline press to perform decline press exercises, a preacher curls to perform preacher curls exercises, a military press to perform military press exercises, an incline press to perform incline press exercises and a bench press to perform bench press exercises.

The plurality of modes may include a decline press mode to perform decline press exercises and the plurality of modes may include a preacher curls mode to perform preacher curls exercises.

The plurality of modes may include a military press mode to perform military press exercises, and the plurality of modes may include an inclined press mode to perform inclined press exercises.

The polarity of modes may include a bench press mode to perform bench press exercises.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention includes an exercise device which may operate in a multitude of operating modes which may include a decline press, a preacher curls, a military press, a inclined press, and a bench press. These operating modes provide the user with an increased flexibility to receive a varied and near complete exercise routine.

Figure 1:
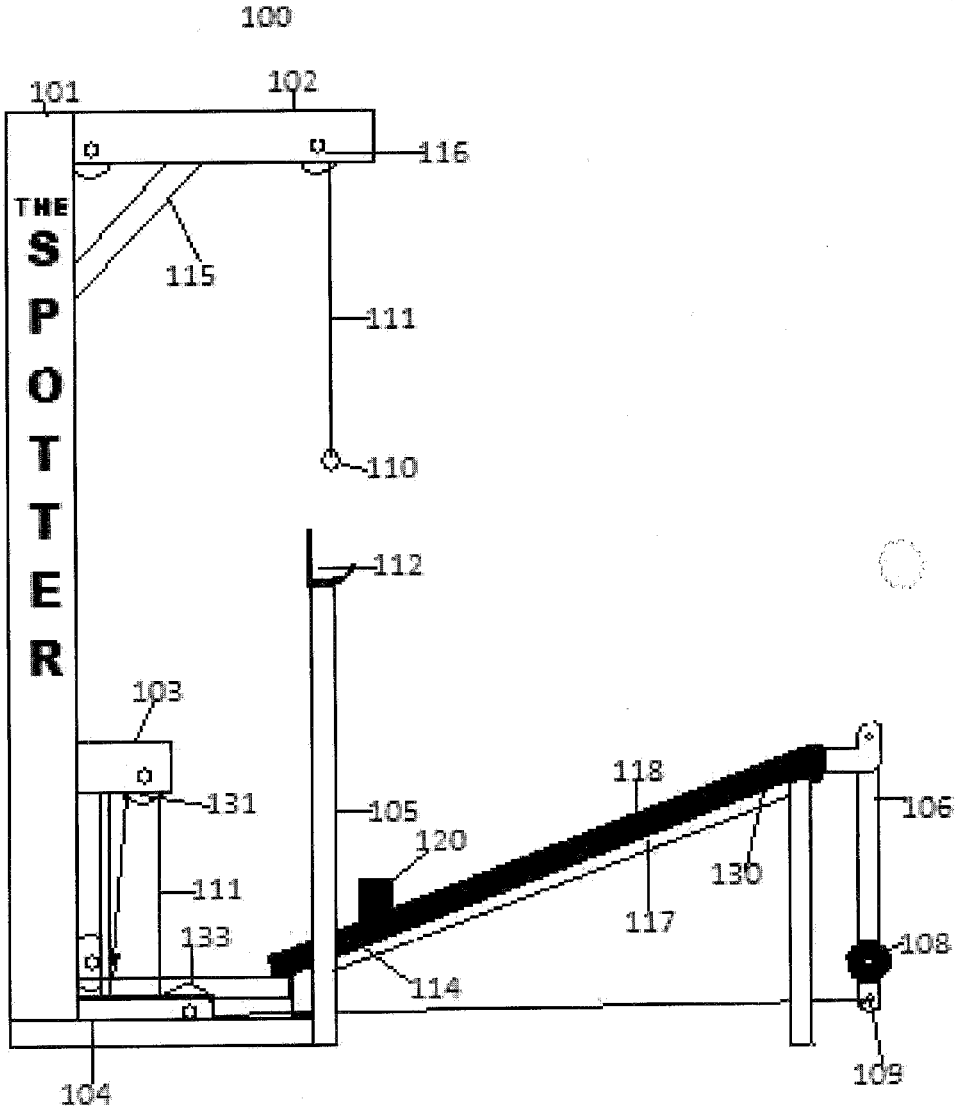
FIG. 1 illustrates the exercise device of the present invention in a decline press mode.

FIG. 1 illustrates the exercise device 100 of the present invention which may include a substantially vertical chimney frame member which extends substantially vertically and may include a longitudinal frame member which may be centrally positioned along the back side of the exercise device 100. The substantially vertical chimney frame member 101 may be connected to a bottom slack adjuster frame member 104 and may be connected to a substantially horizontal crown frame member 102 which may extend from back to front and may be supported by the chimney support frame member 115 which may be connected to the chimney frame member 101. The crown frame member may cooperate with a pulley device 116 to raise and lower a cable 111. The slack adjuster frame member 104 may be connected to a weight chimney frame member 105 which may be substantially vertical in order to support weights (not shown) that may be used by the user and may be connected to a weight holder device 112 which may be shaped to retain the weights (not shown) which may be used by the user. The cable 111 may be connected to a bar holder device 110 to support the weights (not shown) for the user. The bar holder device 110 may be raised or lowered to cooperate with the position of the user.

The substantially horizontal crown frame member 102 may retractably extend and retract outwards for a length which may vary in order to position the bar holder device 110 at a position convenient for the user.

The top slack adjuster frame member 103 and the bottom slack adjuster frame member 104 may retractably extend and retract outwards for a adjustable length which may vary in order to provide a support surface for the user.

The bottom slack adjuster frame member 104 which may include a top pulley 131 cooperates with a top slack adjuster frame member 103 which may include a first bottom pulley 133 and a second bottom pulley 135 with cable 111.

FIG. 1 additionally illustrates a bench frame member 117 which may serve to support the torso and head of the user and may be positioned at an angle to define a inclined surface which may cooperate with a head rest pad 119, a shoulder rest pad 120 and a bench pad 118 to support the head, shoulders and torso of the user. The bench frame member 117 may be connected to a support frame member 135 to support the bench frame member 117. Furthermore, FIG. 1 illustrates a leg extension frame member 106 which may be pivotably connected to the bench frame member 117 and may rotate about an axle 107.

Figure 7:
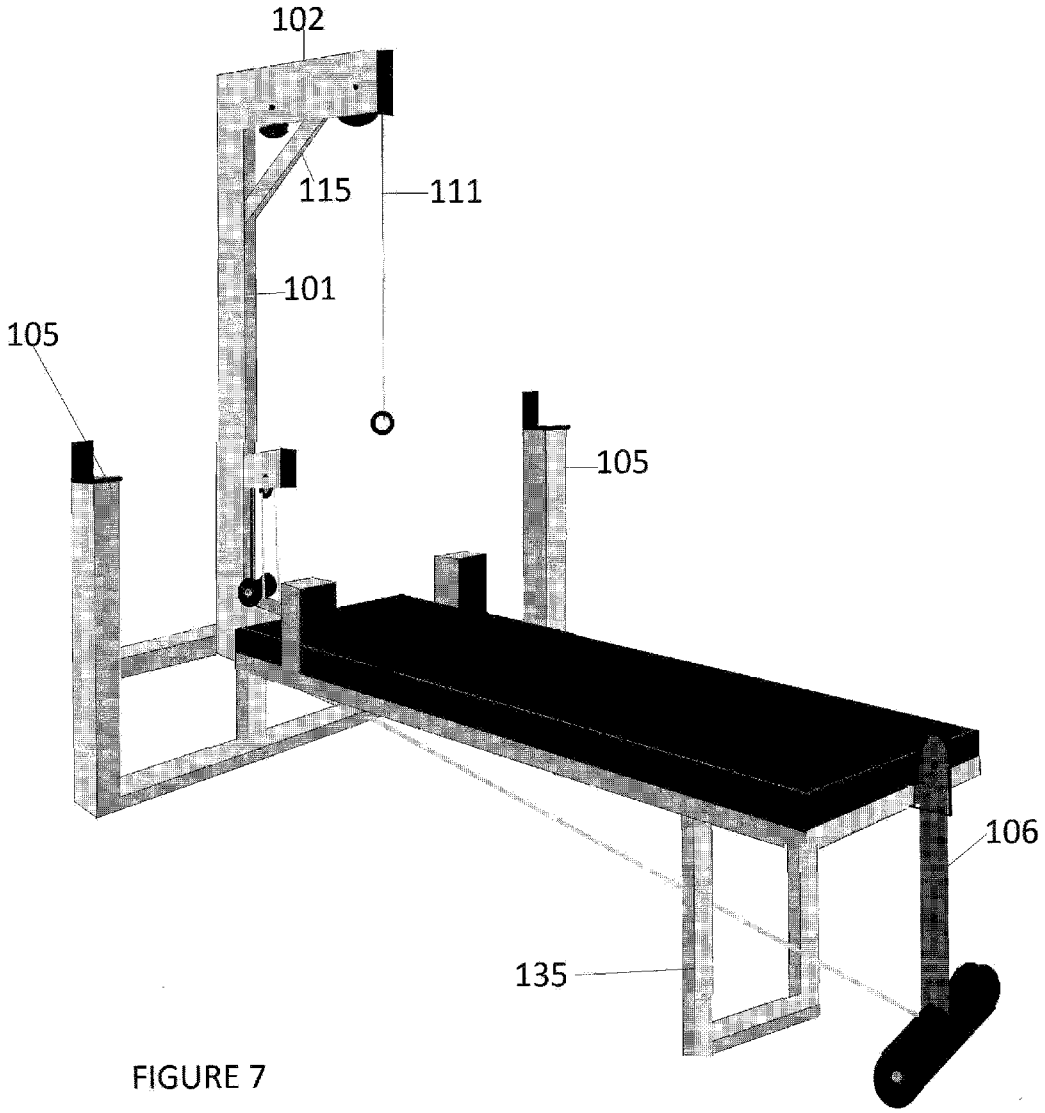
FIG. 7 illustrates a perspective view of the exercise device in the decline press mode.

FIG. 7 illustrates a perspective view of the exercise device 100 in a decline press mode to perform decline press exercises.

Figure 2:
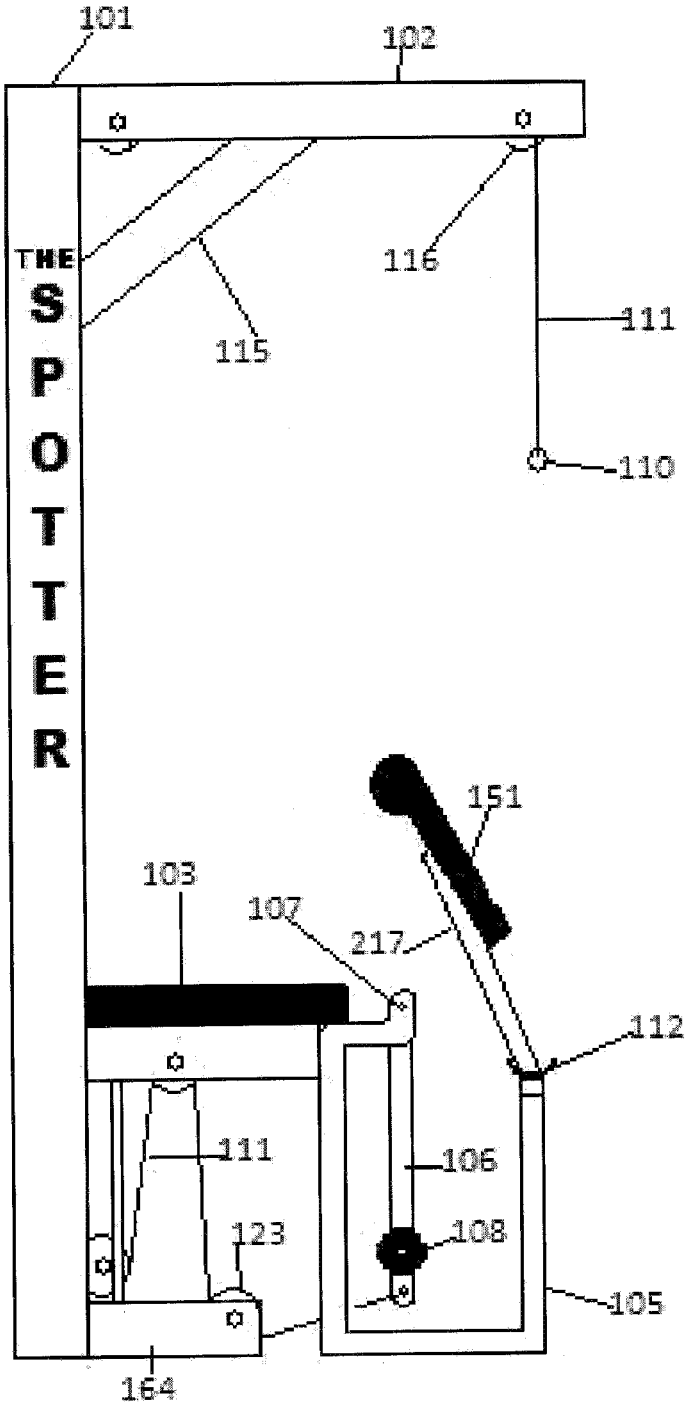
FIG. 2 illustrates the exercise device of the present invention in a preacher curls mode.

FIG. 2 illustrates the exercise device 100 of the present invention in a preacher curls mode which may include a substantially vertical chimney frame member 101 which extends substantially vertically and may include a longitudinal frame member which may be centrally positioned along the back side of the exercise device 100. The substantially vertical chimney frame member 101 may be connected to a bottom slack adjuster frame member 104 and may be connected to a substantially horizontal crown frame member 102 which may retractably extend and retract from back to front and may be supported by the chimney support frame member 115 which may be connected to the chimney frame member 101. The crown frame member 102 may cooperate with a pulley device 116 to raise and lower a cable 111. The weight chimney frame member 105 which may be substantially vertical in order to support a pad 151 that may be used by the user and may be connected to a weight holder device 112 which may be shaped to retain the weights (not shown) which may be used by the user. The cable 111 may be connected to a bar holder device 110 to support the weights (not shown) for the user. The bar holder device 110 may be raised or lowered to cooperate with the position of the user.

The substantially horizontal crown frame member 102 may retractably extend and retract outwards for a length which may vary in order to position the bar holder device 110 at a position convenient for the user.

The top slack adjuster frame member 103 and the bottom slack adjuster frame member 104 may retractably extend and retract outwards for a adjustable length which may vary in order to provide a support surface for the user.

The bottom slack adjuster frame member 104 which may include a top pulley 131 cooperates with a top slack adjuster frame member 103 which may include a first bottom pulley 133 and a second bottom pulley 135 with cable 111.

FIG. 2 additionally illustrates a bench frame member 217 which may serve to support the torso and head of the user and may be positioned at an angle to define a inclined surface. The bench frame member 217 may be connected to the weight chimney frame member 105 to support the bench frame member 217. Furthermore, FIG. 2 illustrates a leg extension frame member 106 which may be pivotably connected to the top slack adjuster frame member 103 to rotate about an axle 107.

Figure 6:
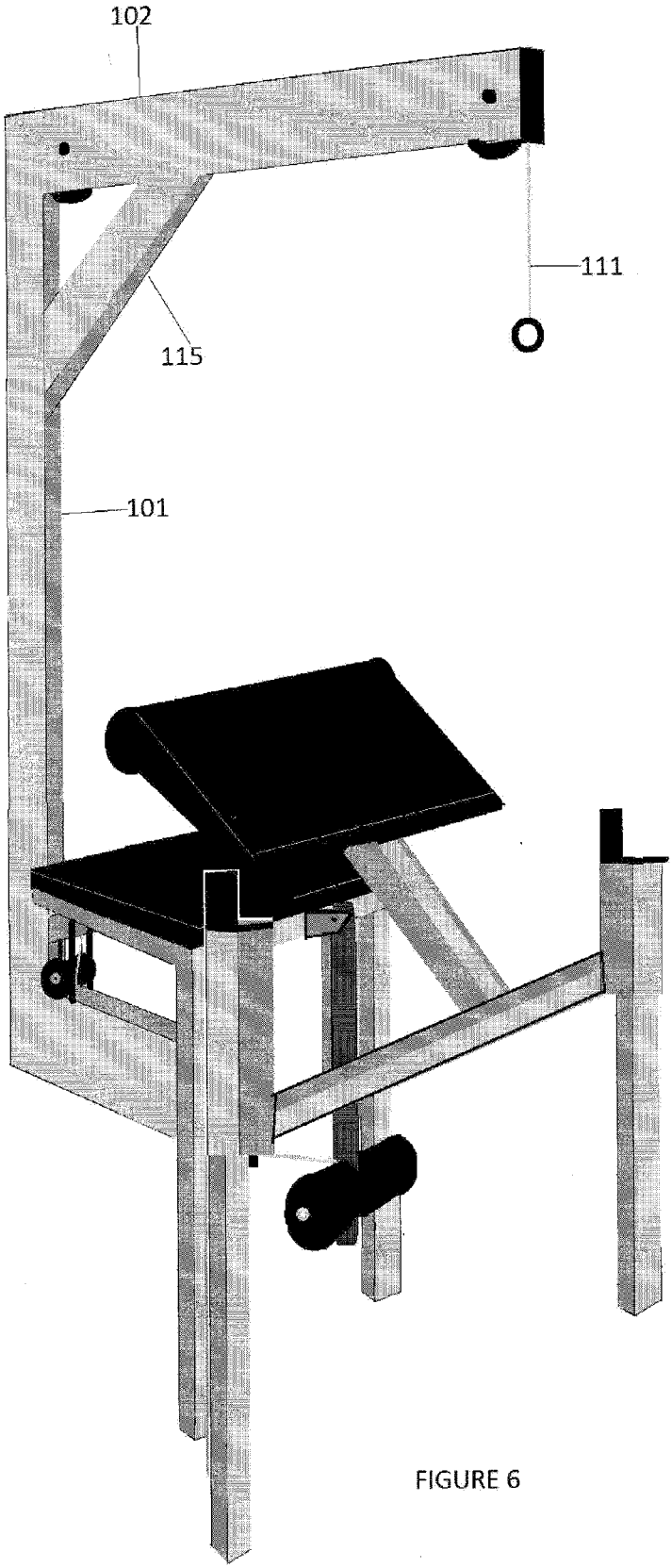
FIG. 6 illustrates a perspective view of the exercise device in the preacher curls mode.

FIG. 6 illustrates a perspective view of the exercise device 100 in a preacher curls mode to perform preacher curls exercises.

Figure 3:
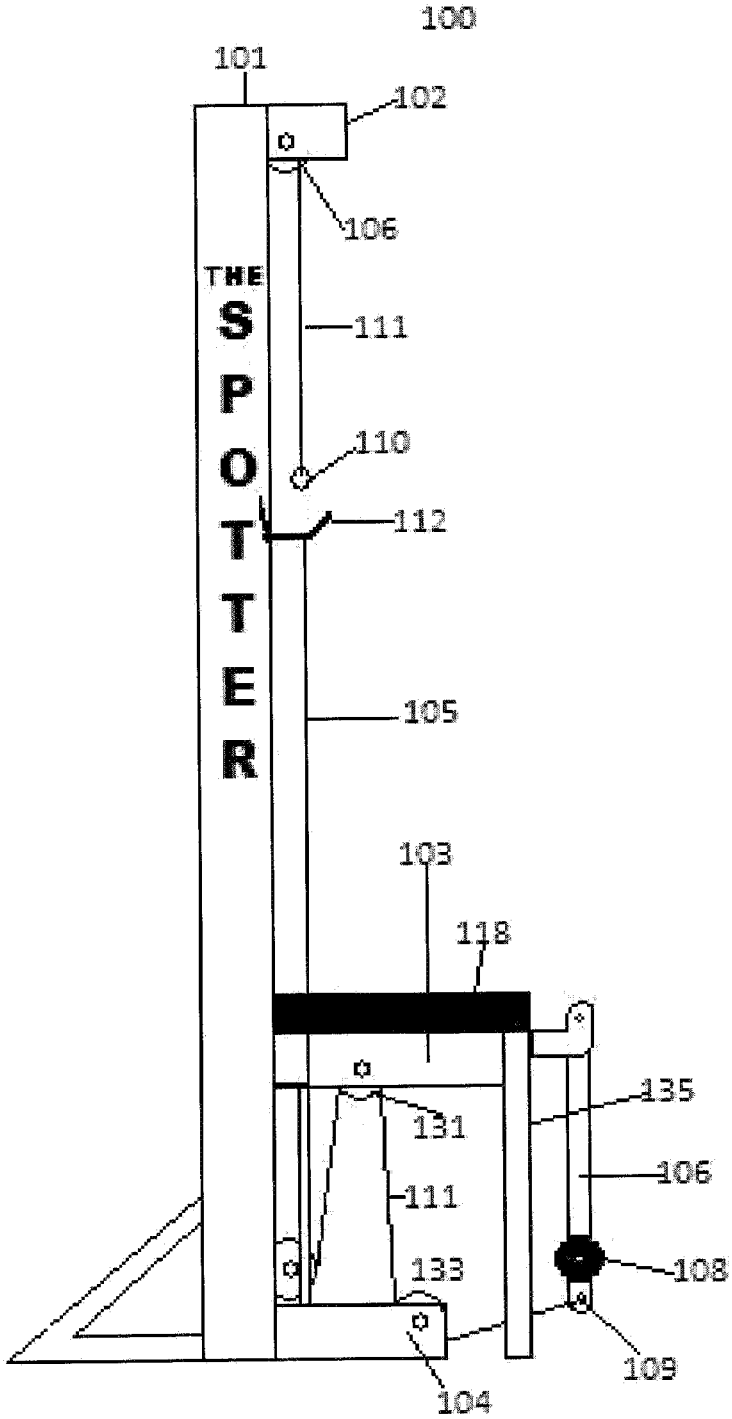
FIG. 3 illustrates the exercise device of the present invention in a military press mode.

FIG. 3 illustrates the exercise device 100 of the present invention which may be in a military press mode and which may include a substantially vertical chimney frame member 101 which extends substantially vertically and may include a longitudinal frame member which may be centrally positioned along the back side of the exercise device 100. The substantially vertical chimney frame member 101 may be connected to a bottom slack adjuster frame member 104 and may be connected to a substantially horizontal crown frame member 102 which may retractably extend and retract from back to front. The crown frame member 102 may cooperate with a pulley device 116 to raise and lower a cable 111. The slack adjuster frame member 104 may be connected to a weight holder device 112 which may be shaped to retain the weights (not shown) which may be used by the user. The cable 111 may be connected to a bar holder device 110 to support the weights (not shown) for the user. The bar holder device 110 may be raised or lowered to cooperate with the position of the user.

The substantially horizontal crown frame member 102 may retractably extend and retract outwards for a length which may vary in order to position the bar holder device 110 at a position convenient for the user.

The top slack adjuster frame member 103 and the bottom slack adjuster frame member 104 may retractably extend and retract outwards for a adjustable length which may vary in order to provide a support surface for the user.

The bottom slack adjuster frame member 104 which may include a top pulley 131 cooperates with a top slack adjuster frame member 103 which may include a first bottom pulley 133 and a second bottom pulley 135 with cable 111.

FIG. 3 additionally illustrates a bench frame member 117 which may serve to support the torso and head of the user and may be positioned substantially flat to support the head, shoulders and torso of the user. The bench frame member 117 may be connected to a support frame member 135 to support the bench frame member 117. Furthermore, FIG. 3 illustrates a leg extension frame member 106 which may be pivotably connected to the bench frame member 117 and may rotate about an axle 107.

Figure 8:
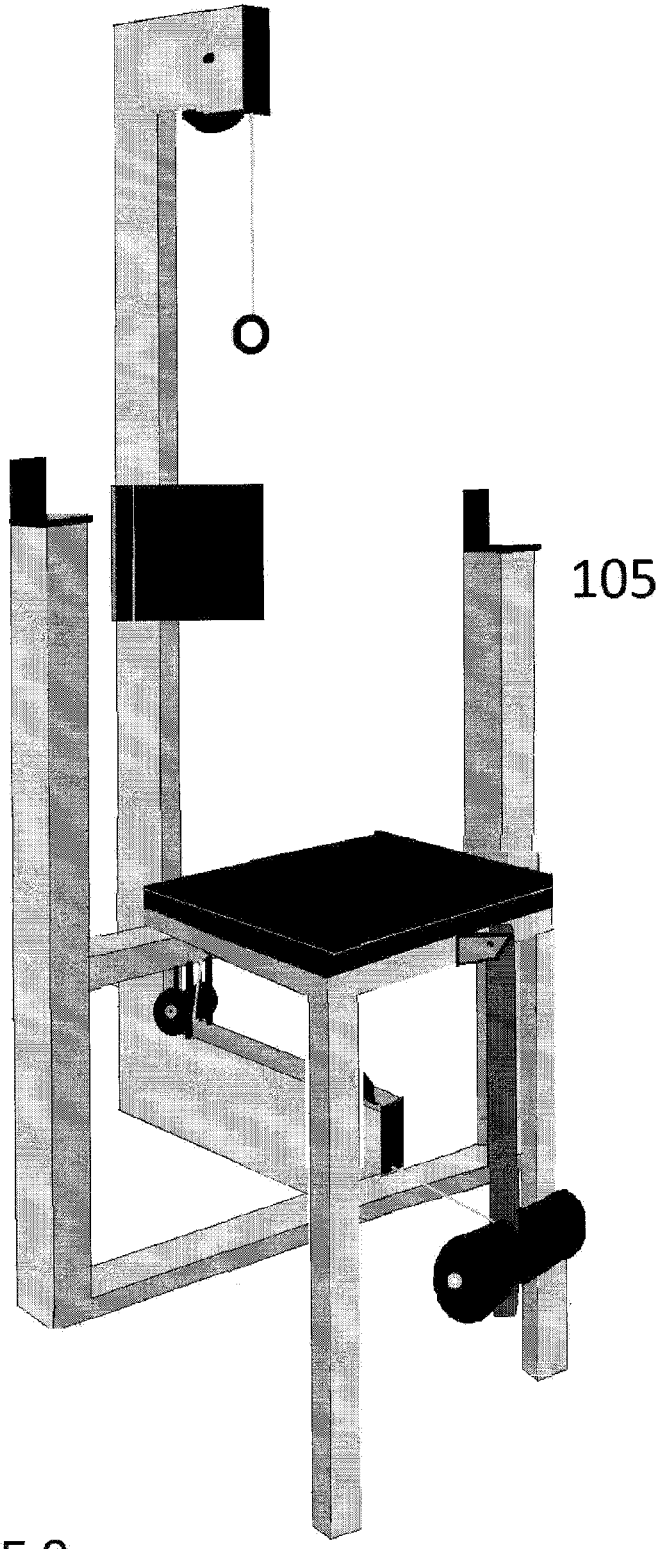
FIG. 8 illustrates a perspective view of the exercise device in the military press mode.
Figure 9:
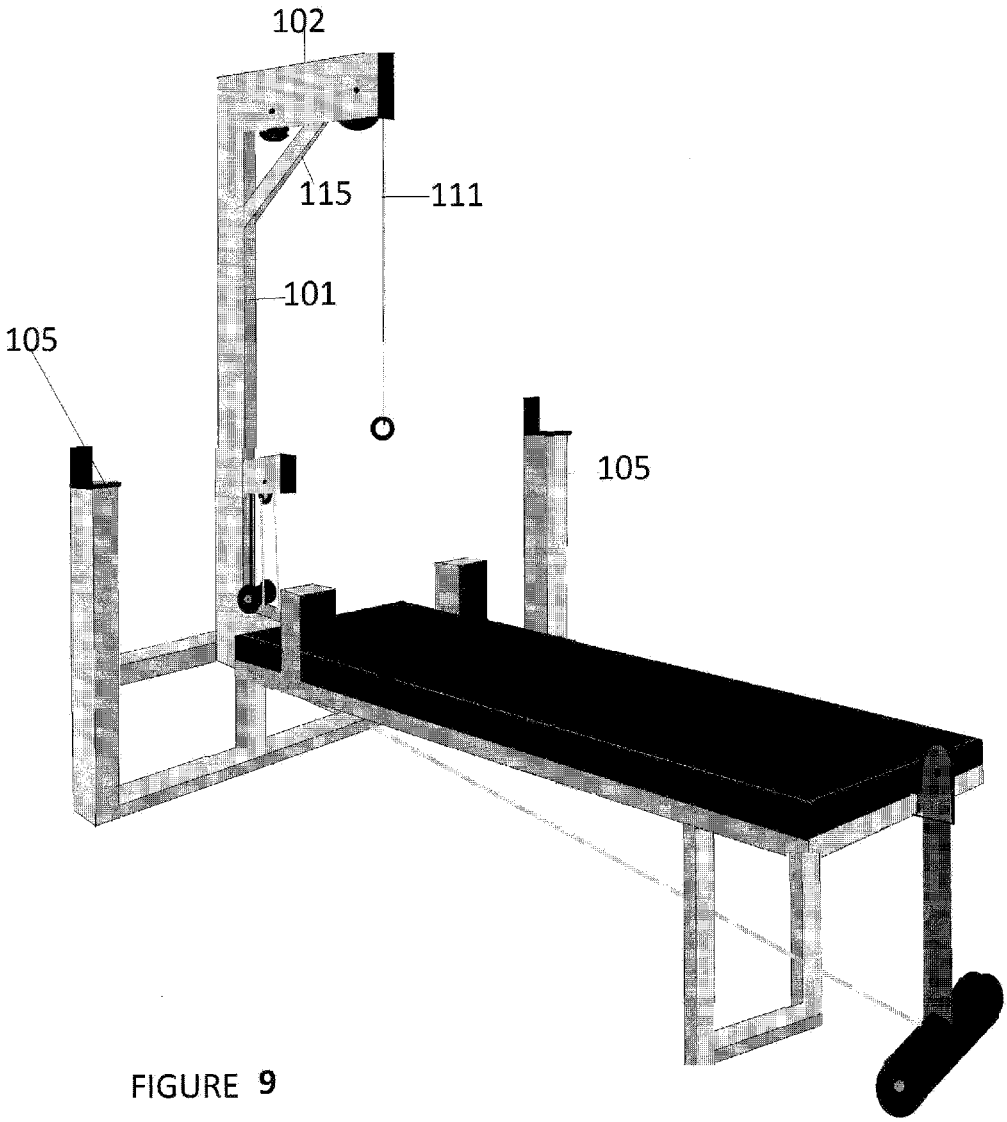
FIG. 9 illustrates another perspective view of the exercise device in the decline press mode.

FIG. 8 illustrates a perspective view of the exercise device 100 in a military press mode to perform military press exercises.

Figure 4:
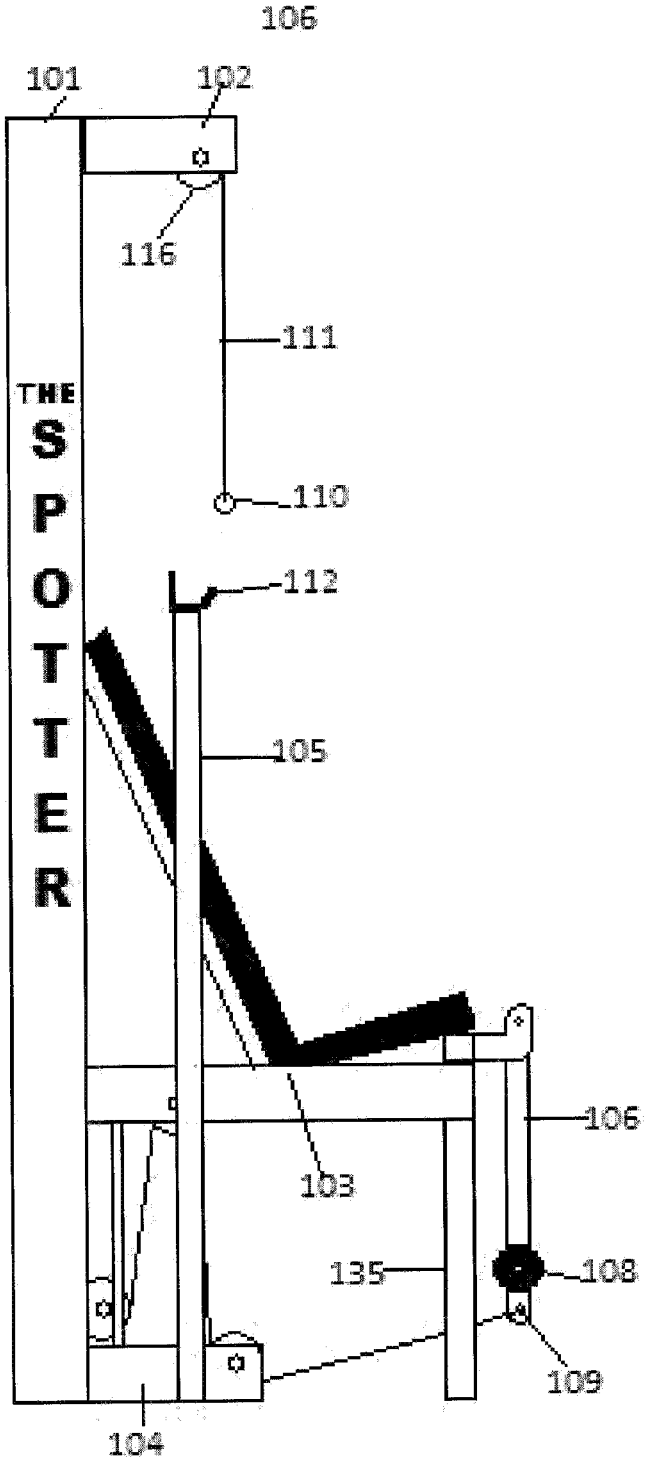
FIG. 4 illustrates the exercise device of the present invention in an inclined press mode.

FIG. 4 illustrates the exercise device 100 of the present invention which may be in an incline press mode and which may include a substantially vertical chimney frame member 101 which extends substantially vertically and may include a longitudinal frame member which may be centrally positioned along the back side of the exercise device 100. The substantially vertical chimney frame member 101 may be connected to a bottom slack adjuster frame member 104 and may be connected to a substantially horizontal crown frame member 102 which may retractably extend and retract from back to front. The crown frame member 102 may cooperate with a pulley device 116 to raise and lower a cable 111. The slack adjuster frame member 104 may be connected to a weight holder device 112 which may be shaped to retain the weights (not shown) which may be used by the user. The cable 111 may be connected to a bar holder device 110 to support the weights (not shown) for the user. The bar holder device 110 may be raised or lowered to cooperate with the position of the user.

The substantially horizontal crown frame member 102 may retractably extend and retract outwards for a length which may vary in order to position the bar holder device 110 at a position convenient for the user.

The top slack adjuster frame member 103 and the bottom slack adjuster frame member 104 may retractably extend and retract outwards for a adjustable length which may vary in order to provide a support surface for the user.

The bottom slack adjuster frame member 104 which may include a top pulley 131 cooperates with a top slack adjuster frame member 103 which may include a first bottom pulley 133 and a second bottom pulley 135 with cable 111.

FIG. 4 additionally illustrates a bench frame member 117 which may serve to support the torso and head of the user and may be positioned as a substantial L-shaped member to support the head, shoulders and torso of the user. The bench frame member 117 may be connected to a support frame member 135 to support the bench frame member 117. Furthermore, FIG. 4 illustrates a leg extension frame member 106 which may be pivotably connected to the bench frame member 117 and may rotate about an axle 107.

Figure 10:
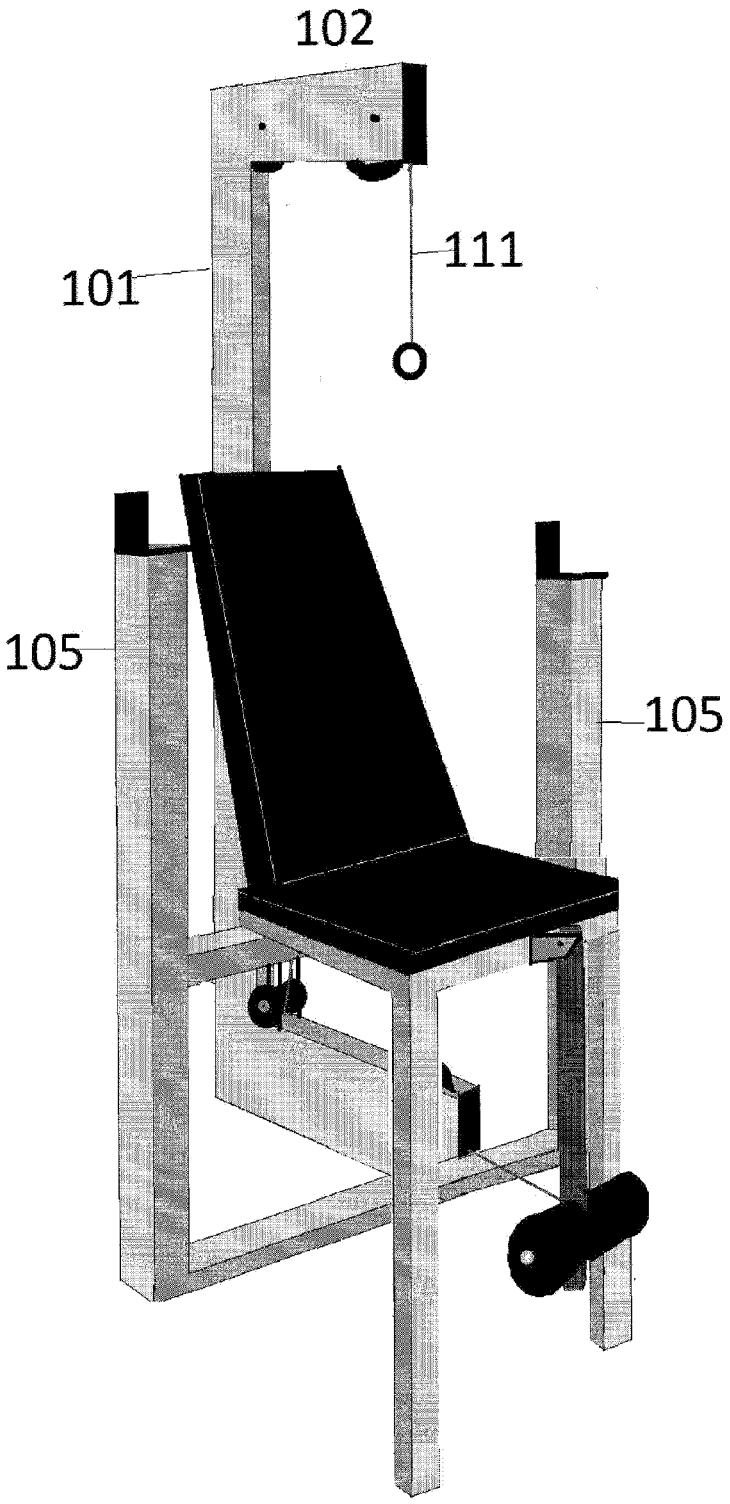
FIG. 10 illustrates a perspective view of the exercise device in the inclined press mode.

FIG. 10 illustrates a perspective view of the exercise device 100 in a inclined press mode to perform incline press exercises.

Figure 5:
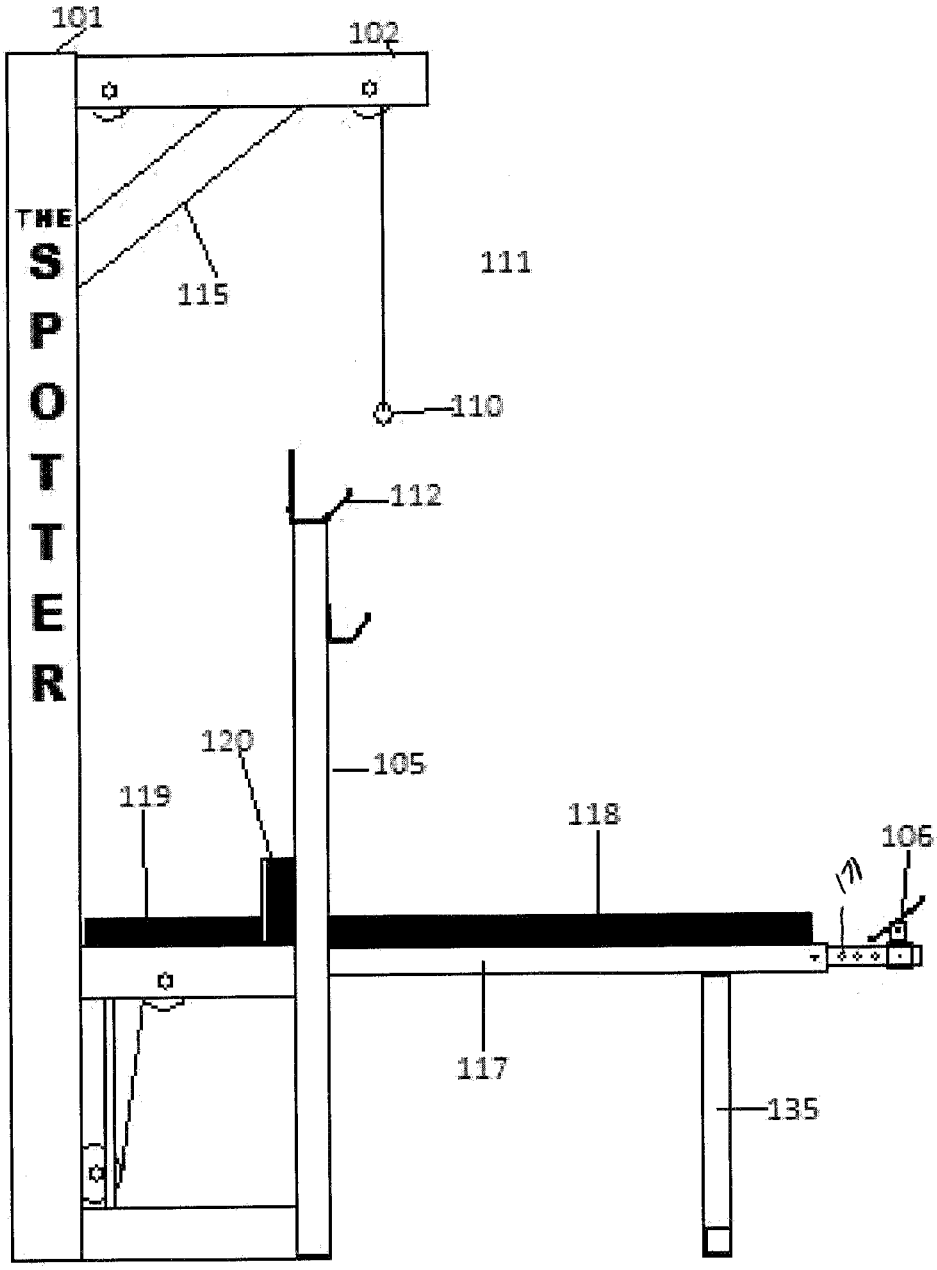
FIG. 5 illustrates the exercise device of the present invention in a bench press mode.

FIG. 5 illustrates the exercise device 100 of the present invention which may be in a bench press mode and which may include a substantially vertical chimney frame member 101 which extends substantially vertically and may include a longitudinal frame member which may be centrally positioned along the back side of the exercise device 100. The substantially vertical chimney frame member 101 may be connected to a bottom slack adjuster frame member 104 and may be connected to a substantially horizontal crown frame member 102 which may extend from back to front. The crown frame member 102 may cooperate with a pulley device 116 to raise and lower a cable 111. The slack adjuster frame member 104 may be connected to a weight holder device 112 which may be shaped to retain the weights (not shown) which may be used by the user. The cable 111 may be connected to a bar holder device 110 to support the weights (not shown) for the user. The bar holder device 110 may be raised or lowered to cooperate with the position of the user.

An advantage of the present invention is that the bar holder device 110 may only move to a predetermined position and then it is restrained from further movement. This eliminates the need for a second user which may be called a spotter. The spotter prevent the weights on the bar holder device 110 from reaching the user and causing injury to the user as a result of the following weights. The bar holder device 110 is connected to a single cable 111 which may be connected to the leg extension frame member 106. The leg extension frame member 106 may be restricted from movement which may be excessive by a pin 171 which may be positioned in an aperture to restrict the movement of the leg extension frame member 106. The legs of the user may hold the bar holder device 110 and the pin 171 may restrict the movement of the bar holder device 110. If the user feet and legs should disengaged the leg extension frame member 106 the travel of the bar holder device 110 is limited by the pin 171.

The substantially horizontal crown frame member 102 may retractably extend and retract outwards for a length which may vary in order to position the bar holder device 110 at a position convenient for the user.

The top slack adjuster frame member 103 and the bottom slack adjuster frame member 104 may retractably extend and retract outwards for an adjustable length which may vary in order to provide a support surface for the user.

The bottom slack adjuster frame member 104 which may include a top pulley 131 cooperates with a top slack adjuster frame member 103 which may include a first bottom pulley 133 and a second bottom pulley 135 with cable 111.

FIG. 5 additionally illustrates a bench frame member 117 which may serve to support the torso and head of the user and may be positioned substantially horizontal in order to support the torso and head of the user and may cooperate with a head rest pad 119, a shoulder rest pad 120 and a bench pad 118 to support the head, shoulders and torso of the user. The bench frame member 117 may be connected to a support frame member 135 to support the bench frame member 117. Furthermore, FIG. 5 illustrates a leg extension frame member 106 which may be pivotably connected to the bench frame member 117 and may rotate about an axle 107.

Figure 11:
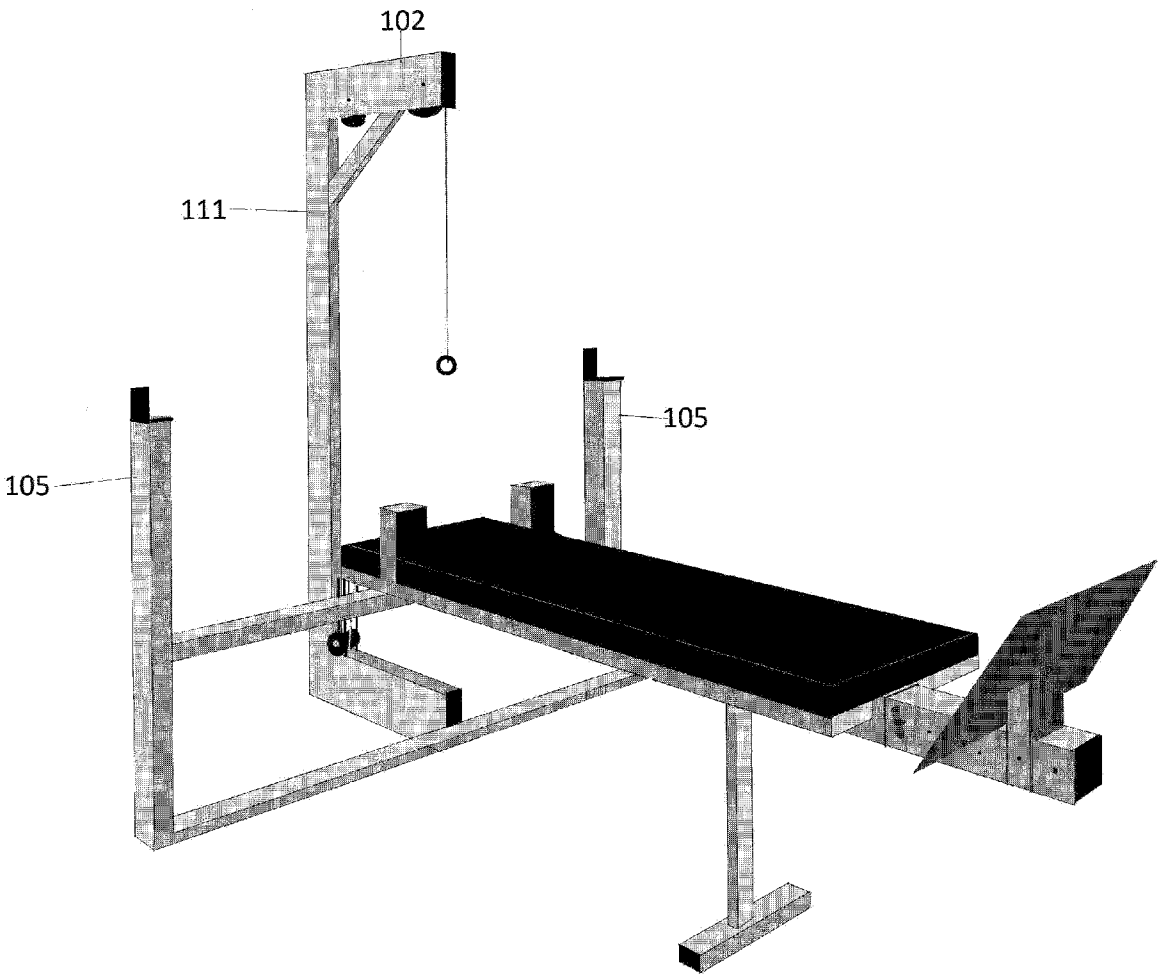
FIG. 11 illustrates a perspective view of the exercise device in the bench press mode.

FIG. 11 illustrates a perspective view of the exercise device 100 in a bench press mode to perform bench press exercises.

Figure 12:
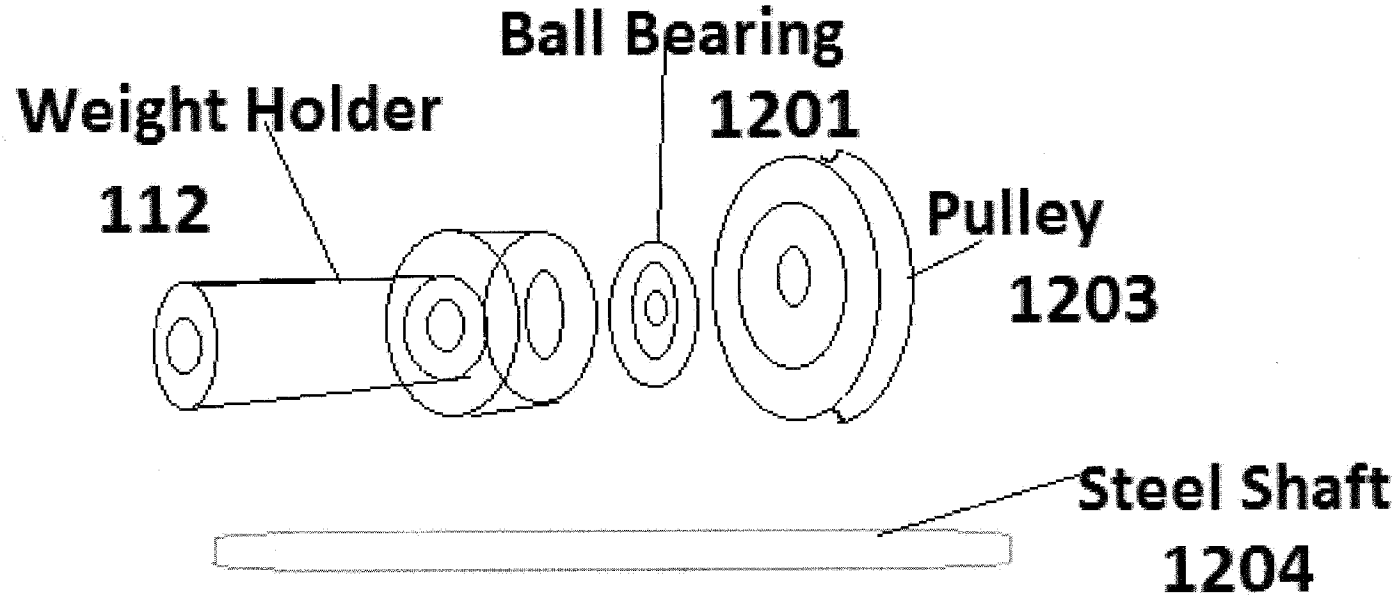
FIG. 12 illustrates an exploded view of the weight holder device of the present invention.

FIG. 12 illustrates the weight holder 112 which may include a shaft 1204 to cooperate with ball bearing 1201 and a pulley 1203.

Figure 13:
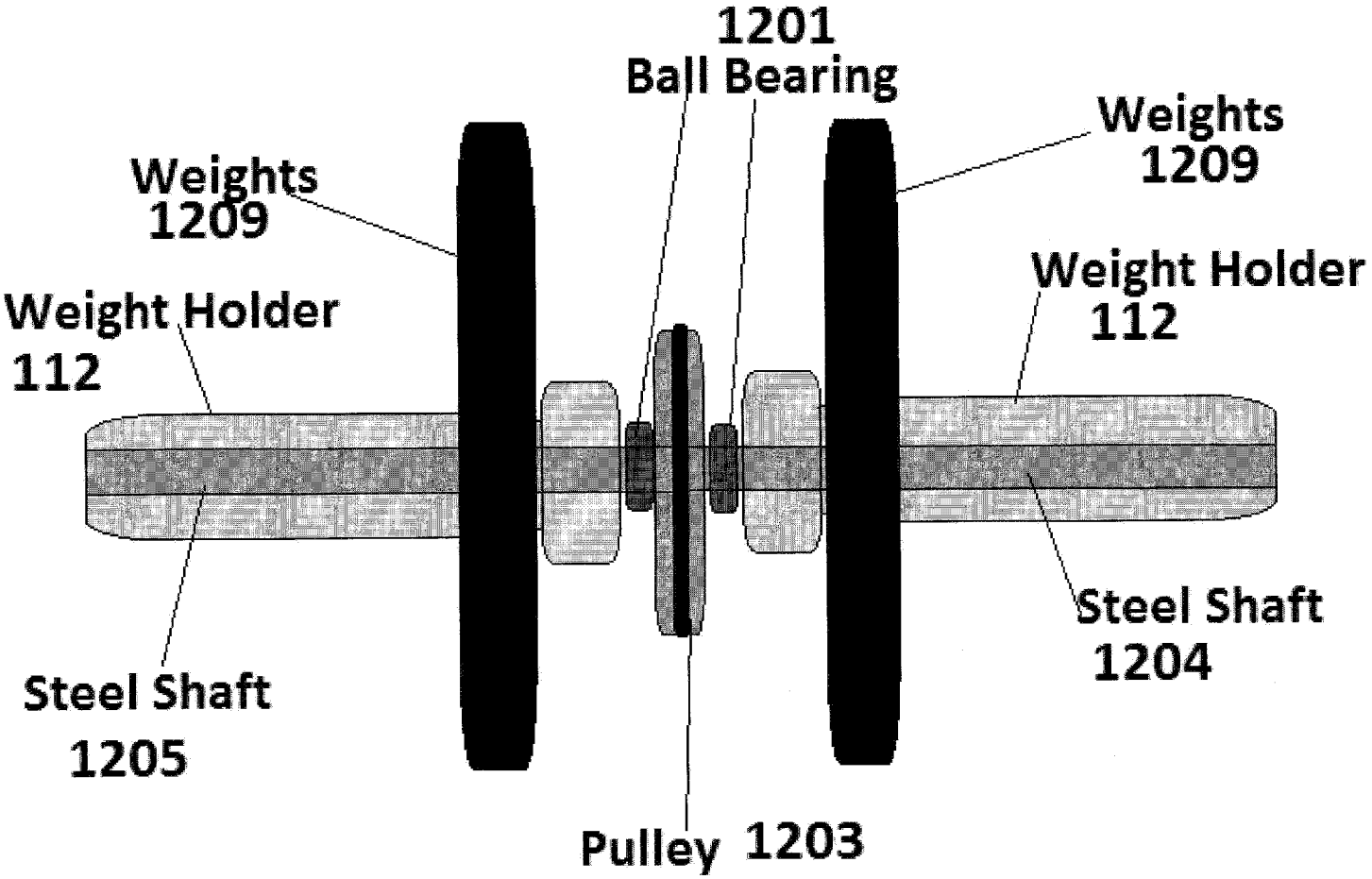
FIG. 13 illustrates a side view of the weight holder device.

FIG. 13 illustrates a weight holder 112 and illustrates weights 1209 which may be connected to the weight holder 112. FIG. 13 illustrates a ball bearing 1201 which may be connected to the shaft 1205.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An exercise device for providing exercise for a user, comprising:

a substantially vertical chimney frame member;

a substantially horizontal crown frame member connected to the substantially vertical chimney frame member;

a slack adjuster frame member to provide a plurality of exercise modes;

a single cable with a first end and a second end;

a bar holder device, connected to the first end, to hold a bar to be lifted by the user;

a leg extension frame member connected to the the second end; and, wherein the leg extension frame member is operated by a leg of the user to hold, raise, and lower the bar holder device.

2. An exercise device for providing exercise for a user as in claim 1, wherein the slack adjuster frame member includes a top slack adjuster frame member.

3. An exercise device for providing exercise for a user as in claim 1, wherein the slack adjuster frame member includes a bottom slack adjuster frame member.

4. An exercise device for providing exercise for a user as in claim 1, wherein the plurality of operating modes includes at least one operating mode from the group of a bench press to perform bench press exercises, a decline press to perform decline press exercises, a preacher curls to perform preacher curls exercises, a military press to perform military press exercises, and an incline press to perform incline press exercises.

5. An exercise device for providing exercise for a user as in claim 1, wherein the plurality of modes includes a decline press mode to perform decline press exercises.

6. An exercise device for providing exercise for a user as in claim 1, wherein the plurality of modes includes a preacher curls mode to perform preacher curls exercises.

7. An exercise device for providing exercise for a user as in claim 1, wherein the plurality of modes includes a military press mode to perform military press exercises.

8. An exercise device for providing exercise for a user as in claim 1, wherein the plurality of modes includes an inclined press mode to perform inclined press exercises.

9. An exercise device for providing exercise for a user as in claim 1, wherein the plurality of modes includes a bench press mode to perform bench press exercises.

* * * * *